US006015846A

United States Patent [19]

Toussaint et al.

[11] Patent Number: 6,015,846

[45] **Date of Patent: *Jan. 18, 2000**

[54] METHOD OF IMPROVING THE PROPERTIES OF RECLAIMED SAND USED FOR THE PRODUCTION OF FOUNDRY MOULDS AND CORES

[75] Inventors: Philippe Marie Toussaint, Saint Martin-de-Boscherville; Patrick Robert Queval, Duclair, both of France; Johannes-Adolf-Jacobus Geraedts, Roggel, Netherlands; Jacques Andre Caumont, Le-Grande-Ouevilly, France

[73] Assignee: Borden France S.A., Deville-Les-Rouen, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/532,807

[22] PCT Filed: May 10, 1994

[86] PCT No.: PCT/GB94/01005

§ 371 Date: Dec. 29, 1995

§ 102(e) Date: Dec. 29, 1995

[87] PCT Pub. No.: WO94/26439

PCT Pub. Date: Nov. 24, 1994

[30] Foreign Application Priority Data

May 11, 1993 [GB] United Kingdom ..... 9309615

[51] Int. Cl.[7] ..... B22C 1/18

[52] U.S. Cl. ..... 523/142; 524/445; 524/447; 524/591; 524/593; 524/594

[58] Field of Search ..... 523/142; 524/445, 524/447, 593, 594, 591; 106/490

[56] References Cited

U.S. PATENT DOCUMENTS

| | | | |
|---|---|---|---|
| 5,043,412 | 8/1991 | Chandramouli et al. | 528/129 |
| 5,190,993 | 3/1993 | Iyer | 523/145 |

FOREIGN PATENT DOCUMENTS

| | | |
|---|---|---|
| 0027333 | 9/1980 | European Pat. Off. . |
| 2140080 | 2/1973 | Germany . |

OTHER PUBLICATIONS

Hawley's Condensed Chemical Dictionary, 12ed. pp. 288, 668, 1993.

Cast Metals, vol. 3, Nov. 2, 1990, pp. 62–67.

*Primary Examiner*—Marion McCamish
*Assistant Examiner*—John J. Guarriello
*Attorney, Agent, or Firm*—Stevens, Davis, Miller & Mosher, L.L.P.

[57] ABSTRACT

Particulate refractory aggregate containing elutable alkali is treated with a particulate active clay having a particle size of less than 0.5 mm in order to reduce the level of the elutable alkali. Sand recovered from spent foundry moulds and cores produced from alkaline binders can be treated to reduce its elutable alkali content and then recycled for further foundry use.

29 Claims, 1 Drawing Sheet

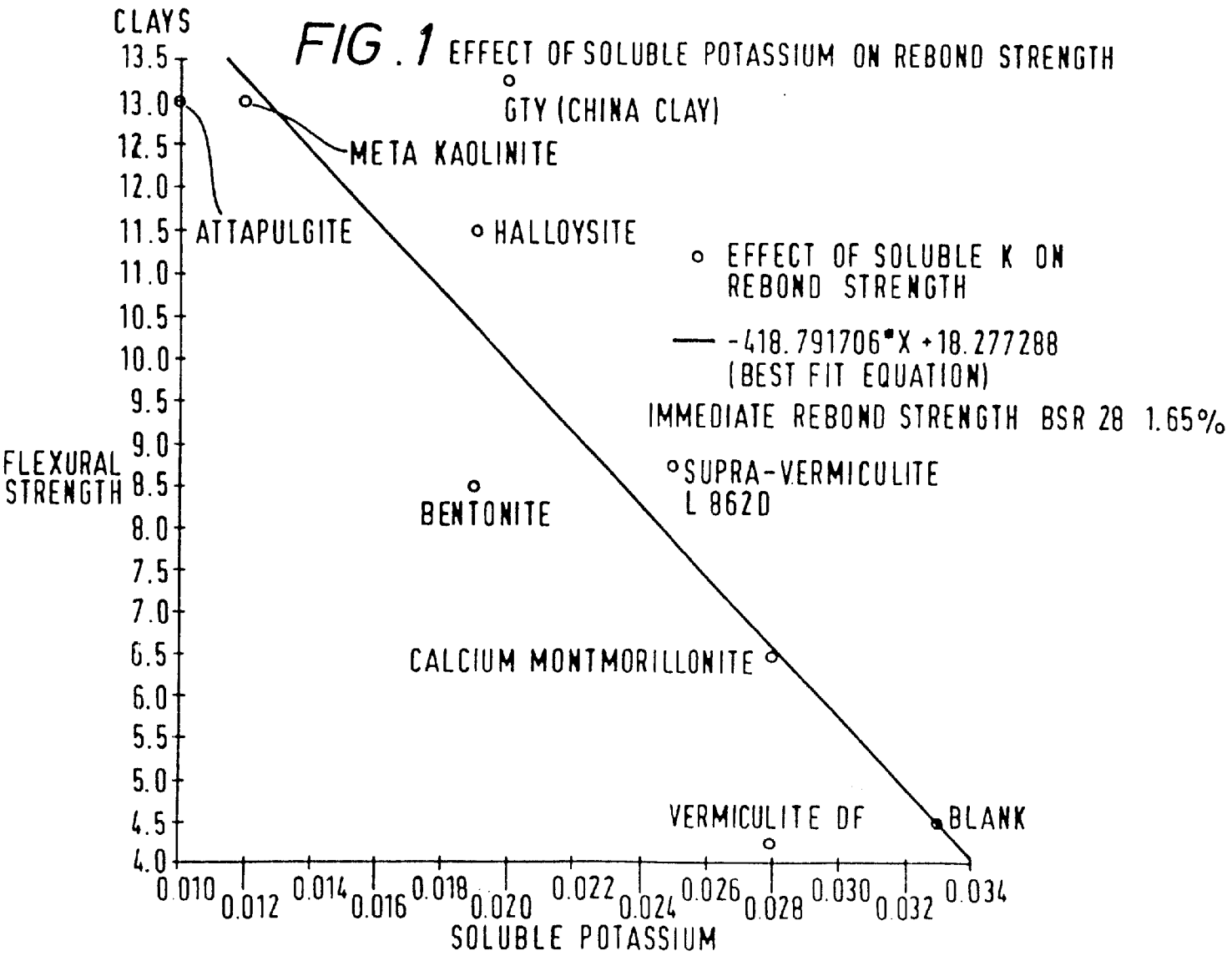
FIG. 1 EFFECT OF SOLUBLE POTASSIUM ON REBOND STRENGTH
CLAYS
FLEXURAL STRENGTH
13.5
13.0
12.5
12.0
11.5
11.0
10.5
10.0
9.5
9.0
8.5
8.0
7.5
7.0
6.5
6.0
5.5
5.0
4.5
4.0
0.010
0.012
0.014
0.016
0.018
0.020
0.022
0.024
0.026
0.028
0.030
0.032
0.034
SOLUBLE POTASSIUM
GTY (CHINA CLAY)
META KAOLINITE
ATTAPULGITE
HALLOYSITE
BENTONITE
CALCIUM MONTMORILLONITE
VERMICULITE DF
BLANK
SUPRA-VERMICULITE L 862D
EFFECT OF SOLUBLE K ON REBOND STRENGTH
-418.791706*X +18.277288
(BEST FIT EQUATION)
IMMEDIATE REBOND STRENGTH BSR 28 1.65%

METHOD OF IMPROVING THE PROPERTIES OF RECLAIMED SAND USED FOR THE PRODUCTION OF FOUNDRY MOULDS AND CORES

The use of ester-cured alkaline phenolic resins for the production of foundry moulds and cores has had a major influence on the industry due to the improvements in the casting finish possible and in the environmental benefits achieved. The techniques were first developed commercially by Borden (UK) Limited. Examples of such techniques are disclosed in EP-A-085512 and EP-A-086615.

Despite the advantages gained by the use of ester-cured phenolic resins, a serious disadvantage is that the rebond strengths obtained with sands reclaimed from moulds and cores made with ester-cured phenolic resins are generally far inferior to the strengths obtained with new sand or sand reclaimed from other processes. This is also true of ester- and $CO_2$- cured silicate resin systems. For environmental and commercial reasons it is desirable to recycle as much reclaimed sand as possible and thereby limit, as far as possible, the dumping of waste sand.

Various treatments have been proposed which seek to improve the rebond strength of ester-cured phenolics on reclaimed sand. The most common treatments are mechanical attrition and thermal reclamation though other processes, such as wet scrubbing and the use of additives, have been used. One of the most successful additives employed is that described in EP-A-336,533.

Procedures which employ thermal reclamation of the sand (which reduces loss on ignition due to a build up of organic residues) can result in a higher rebond strength than sand treated by simple mechanical attrition. There is some evidence (e.g., Sedlak et al, Cast Metals, Vol 3, 2, 1990) which suggests that the poor rebond strengths on reclaimed sand correlate with the level of elutable alkali in the sand. Thermal treatment alone does not reduce the level of elutable alkali. In fact, it can increase it by releasing metal salts from the organic matrix. Furthermore, the presence of the alkali metal can cause fusion of the sand particles through glass formation which precludes the use of certain thermal treatment processes, such as those employing fluidised beds.

We have now discovered that by using certain inorganic additives the levels of elutable alkali metal in particulate refractory aggregates containing elutable alkali can be dramatically reduced. The invention which is based on this discovery is particularly applicable to reducing the level of elutable alkali in sand recovered or reclaimed from spent foundry moulds and cores that had been produced using alkaline binder systems to bind the sand together. Furthermore, the problem of silicate fusion, associated with the presence of these materials during thermal reclamation, may be eliminated according to the invention.

An object of the present invention is to provide a novel treatment of particulate refractory aggregate containing elutable alkali, such as is recovered or reclaimed from spent foundry moulds or cores, to improve its usefulness in the production of new foundry moulds and cores.

A further object is to provide a foundry moulding composition which contains particulate refractory aggregate recovered or reclaimed from spent foundry moulds and cores.

A yet further object is to provide a method of making foundry moulds and cores using particulate refractory aggregate recovered or reclaimed from spent foundry moulds and cores.

The present invention provides a particulate refractory composition for use in the manufacture of foundry moulds and cores which comprises a mixture of a particulate refractory aggregate containing elutable alkali with, as an additive thereto, a particulate active clay having a particle size of less than 0.5 mm.

The use of the particulate active clay additive in the composition has the effect of improving the strengths of foundry moulds and cores that are produced using the composition compared to the case where no particulate active clay additive is incorporated into the particulate refractory.

By the term "particulate active clay additive" we mean particulate clay having a particle size of less than 0.5 mm which is capable of reacting with elutable alkali present on the surfaces of the particulate refractory aggregate and which is added to the particulate refractory aggregate to achieve the benefits of the present invention. Thus, the particulate active clay additive is not to be confused with clays which may occur naturally in a refractory aggregate, such as foundry sand. Such naturally-occuring clays are, in any event, inactive towards elutable alkali in such aggregates which typically, according to the present invention, will be derived from the reclamation of spent moulds and cores.

The invention provides special benefits where foundry aggregate obtained from spent foundry moulds and cores is recycled for use in the production of new foundry moulds and cores. Reclaimed sand which has been treated with particulate clay according to the invention is found to give greatly improved rebond strengths with a number of binder systems such that the vast majority of used sand can be recycled.

The particulate clay, which may be a thermally-treated clay, reacts with alkali metal salts which are present on the surface of the refractory surface so that the alkali metal ions are unable to affect, in any substantial way, the subsequent reaction of binder systems used, in the production of foundry moulds and cores, to bind the particulate refractory together.

The reactions of these materials with alkali are well known (see R. M. Barrer, "Chemistry of soil minerals, Part XI. Hydrothermal transformations of metakaolinite in potassium hydroxide", J. Chem-Soc., Dalton Transactions, No. 12 (1972) pp. 1254–9; G. L. Berg et al., "Nature of the thermal effects of products of the reaction of kaolinite with some bases", Izv. Vyss. Ucheb, Zaved; Khim. Tekhnol., 13, 1 (1970) pp. 93–6; and a review is given by Davidovits, Joseph, Geopolymer '88, Vol 1, pp. 25–48). The composition of the "polymeric" products and their use to prepare moulded articles has been disclosed in WO 92/00816 and EP-A-026687. Specific ranges covering the $Na_2O$ or $K_2O$ level are specified for these compositions for satisfactory use in the production of moulded articles and the inorganic material is the principal binding agent for the moulded articles produced therefrom. Other applications described for this type of composition have included the preparation of ceramic-ceramic composites (WO 88/02741) and early high strength concrete compositions (EP-A-153097).

Clays have been used in the 'Greensand' process for many years as part of the binder system for foundry moulds. This process again relies on the clay to impart strength to the moulded article, acting to bind the refractory aggregate. (Kirk Othmer, Clays (survey), p. 212–4).

The particulate clay that may be used in the present invention may be any type that is capable of reacting with alkali metal salts. Examples of suitable materials include kaolins, thermally-treated kaolins, smectites, montmorillonites, bentonites, vermiculites, attapulgites, serpentines, glauconites, illites, allophane and imogolite. Of these materials, kaolin and thermally-treated kaolin are preferred.

We have found that, to be effective in the present invention, the particle size of the particulate clay must be less than 0.5 mm. The use of a particle size greater than 0.5 mm has been found to give rise to no or only very little improvement in the rebond strength of reclaimed sand in mould and core production.

In the present invention the $Na_2O$ or $K_2O$ level obtained by treatment of reclaimed particulate refractory aggregate with the particulate clay is unimportant except that it will be normal practice to add sufficient particulate clay to the aggregate to treat the available alkali metal ions. The required addition level will be modest and can be determined by measuring the free or elutable alkali metal content of the particulate aggregate. This would normally not exceed 1% and, therefore, additions of particulate clay such that an amount in the range of from 0.05% to 5%, preferably from 0.05% to 2%, by weight based on the weight of the aggregate of particulate clay having a particle size less than 0.5 mm will usually be adequate to generate the desired effect.

Water is, preferably, incorporated into the mixture of the particulate refractory aggregate and the particulate active clay in order to improve the performance of the composition. The water may be added separately or may be premixed with the particulate clay to form an aqueous slurry of the clay which may then be added to the refractory aggregate. Typically, water will be added in an amount of from 0.05 to 5%, preferably from 0.05 to 2%, by weight based on the weight of the particulate refractory material.

The particulate refractory aggregate that may be treated with the particulate clay according to the present invention may be any of the types of aggregate that may be used in the production of foundry moulds and cores and that contain elutable alkali. The aggregate may be one that is naturally-occuring or may be spent material from an industrial process. The invention is, of course, especially useful for treating aggregates, particularly sand, that are recovered or reclaimed from spent foundry moulds and cores. By the expression 'spent foundry moulds and cores' we mean such moulds and cores remaining after metal casting and removal of the cast metal shapes in a foundry, wastages and broken-up parts of the same. The aggregate may be subjected to a mechanical reclamation treatment prior to being mixed with the particulate clay or may be subjected to a heat treatment. The reclamation processes are often accompanied by a separation of fines from the aggregate. Thus, any active clay that may have been present is likely to have been lost. It is beneficial, therefore, to make a fresh addition of clay after each reclamation cycle. According to a preferred embodiment the spent foundry aggregate containing the elutable alkali is mixed with the particulate clay and, optionally, water prior to any thermal reclamation treatment and the mixture is then subjected to a thermal reclamation treatment. This has the advantage that the presence of the particulate clay in the thermal reclamation step prevents or reduces glass formation or "sintering" that might otherwise have occurred. The thermal reclamation also, of course, reduces the level of organic contaminants on the aggregate which can also adversely affect the rebonding characteristics.

The problem of poor strength with reclaimed sand is most severe when the binder used for the mould and core manufacture has been an ester-cured phenolic resin or ester or $CO_2$ cured silicate. The invention is therefore most appropriate when attempting to rebond reclaimed sand from this source. Many foundry operations may use more than one binder system such that the reclaimed sand may be derived from a number of processes. Alternatively, a foundry may choose to add a proportion of new sand to recycled reclaimed sand, or both practices may apply. Under these circumstances the rebond strength can be significantly better than when rebonding reclaimed sand from ester-cured phenolic or silicate bound moulds and cores alone. Generally, rebond strengths increase with increasing amounts of new sand or sand reclaimed from other processes. Measurable improvements in rebond strengths are attained by incorporation of the inorganic additive when the majority of the refractory aggregate is reclaimed from moulds and cores made with ester cured phenolic or ester or $CO_2$ cured silicate binders.

According to a preferred embodiment, the present invention provides a method of preparing a particulate refractory composition for use in the manufacture of foundry moulds and cores from spent foundry moulds or cores formed of a refractory material and a binder selected from an ester-cured phenolic resin binder, an ester-cured silicate binder and a $CO_2$-cured silicate binder which method comprises the steps of breaking up the spent foundry moulds or cores and mixing the resulting broken material with a particulate clay having a particle size of less than 0.5 mm, and, optionally, water. Preferably, the mixture is then subjected to a heat treatment at elevated temperature.

The above method is especially useful in the case where the refractory material of the spent moulds and cores is sand. The heat treatment, when employed, is preferably carried out under thermal reclamation conditions, for example at a temperature of from 400° to 1000° C., preferably from 500° to 900° C., and typically about 800° C. for from 1–12, typically 1–4, hours.

The method according to this preferred embodiment preferably further comprises the step of removing dust and/or fines during and/or after the heat treatment. Typically, this is achieved by the application of suction to the particulate refractory material to remove the lighter particles which may be collected in a cyclone for dumping. The amount of fines removed may be controlled by controlling the degree of suction applied.

The mixture of particulate refractory aggregate containing elutable alkali and particulate clay prepared as described above, with or without any subsequent thermal treatment, or material obtained after thermal treatment whether or not fines have been removed can be used as part or all of the particulate refractory material in a foundry moulding composition together with a curable binder system. Alternatively, the aggregate containing elutable alkali, the particulate clay and, optionally, water may be incorporated without prior mixing in a foundry moulding composition together with the binder. Thus, the present invention provides a foundry moulding composition comprising a mixture of a particulate refractory aggregate containing elutable alkali, a liquid curable binder in an amount of from 0.5 to 5% by weight based on the weight of the refractory aggregate and a particulate clay having a particle size of less than 0.5 mm. The particulate clay is, typically, present in an amount of from 0.05 to 5%, preferably from 0.05 to 2%, by weight of the refractory aggregate.

The foundry binder system may be any of the usual systems known in the art and details of such systems will not be required here. For practical purposes, however, most benefits are achieved when the foundry binder system used is one selected from alkaline phenolic resin cured with a liquid or gaseous ester curing agent or a mixture thereof, silicate cured with a liquid ester or silicate cured with carbon dioxide. Alkaline phenolic resin binders are well-known in the art and typically comprise an aqueous alkaline resin produced by condensing a phenolic compound, usually phenol itself, with an aldehyde, usually formaldehyde, at a phenol:aldehyde molar ratio of from 1:1.2 to 1:3 in the presence of a base, such as NaOH or KOH. Such alkaline phenolic resins are known to be cured or hardened by reaction with an ester, such as a carboxylic acid ester, an organic carbonate or a lactone or a mixture of any two or more of these. Details of such materials and how they may be used in the production of foundry moulds and cores are well-known in the foundry art. Reference may, for instance, be made to EP-A-027333 and EP-A-085512. Generally, a foundry mould or core may be made by preparing a mixture containing the particulate aggregate, particulate clay, the ester-curable binder and at least one liquid ester curing agent for the binder, forming the mixture into the desired shape and allowing the ester-curable binder to undergo cure.

Cure of an ester-curable binder may also be effected by gassing with a gaseous or vaporous ester, typically methyl formate. Details of a gaseous ester curing technique are given in EP-A-086615. Generally, a foundry mould or core may be produced using a gassing technique by forming the mixture of aggregate, particulate clay and ester-curable phenolic resin into the desired shape and then gassing the formed mixture with methyl formate vapour. As is known in the art, there are some circumstances where a gassing technique may be combined with the use of a liquid ester/lactone/organic carbonate curing agent.

Silicates, as is well-known in the art, can also be used to bind aggregates, such as sand, to produce foundry moulds and cores. These may be cured by reaction with a liquid ester, lactone, organic carbonate or a mixture of any two or more of these or may be cured by gassing with $CO_2$. In view of the wide knowledge of the use of these binder systems, it is not considered necessary to provide further details here.

Beneficial results are achieved using a particulate clay with a mechanically reclaimed sand without the two materials being subjected together to a subsequent heat treatment prior to mixture with the binder. Although the improvements obtained in this way do not match those obtained in the case where a subsequent heat treatment is used, they are significant in enabling adequate strength performance to be achieved using a reclaimed sand without the expense of thermal reclamation. Obviously, on casting metal into a mould/core produced from compositions described herein a proportion of the sand will attain relatively high temperatures and the presence of the particulate clay additive will act to trap any free alkali in the sand. A further unexpected and striking feature of the invention is that heat treatment of the sand prior to addition of the particulate clay additive is seen to give high rebond strengths although a chemical reaction is unlikely to have occurred.

The small amount of inorganic reaction product, formed by the reaction of the particulate clay with the elutable alkali, plays no part in the bonding process except to prevent the detrimental effects of the free alkali metal salts. The use of the particulate clay additives to improve the rebond strengths obtained with sands reclaimed from moulds and cores prepared using ester-cured phenolic resins and ester or $CO_2$ cured silicates is not known in the prior art. Indeed additions of inorganic powders would normally be considered detrimental to the performance of ester-cured phenolic resins or liquid organic binder systems in general due to reduced mobility of the binder system and 'drying out' problems which would adversely affect the adhesive and cohesive strength of the binder. In fact, we can overcome such problems in either of two ways. Firstly, when powder additions are made to sand to which liquid resin is to be added directly, a further addition of water may be made to maintain a sufficient degree of mobility and to prevent 'drying out'. Secondly, the addition may be made after mould or core making has taken place but prior to reclamation and recycling of the sand for further rebonding. A further facet of the invention is that the treated sand can be thermally reclaimed without fear of glass formation or 'sintering', thereby reducing the organic contaminants on the sand which can also adversely affect the rebonding characteristics.

EXPERIMENTAL

Materials

1. Alkaline Phenolic Resins

1.1 Alkaline Phenolic Resole Resin A

100% Phenol was dissolved in 50% aqueous KOH in an amount corresponding to a KOH:phenol molar ratio of 0.78:1. The solution was heated to reflux and 50% aqueous formaldehyde was added slowly, whilst maintaining reflux, in an amount corresponding to a formaldehyde:phenol molar ratio of 1.9:1. The initial reaction was carried out at a temperature of 80° C. and then the temperature was raised to 95° C. and held until a viscosity in the range of from 100 to 120 cP (ICI cone and plate viscometer, 5 Poise cone at 25° C.) was reached. The temperature was lowered to 80° C. and held once more until the viscosity had reached a value of from 130 to 140 cP (tested as before). The resin thus obtained was then diluted with water and 2.3% methanol by weight (on the resin solution), 1.0% by weight urea and 0.4% by weight of silane were added. The final viscosity was 80 c St (U-tube, G size at 25° C.).

1.2 Alkaline Phenolic Resole Resin B

100% Phenol was dissolved in 50% aqueous KOH in an amount corresponding to a KOH:phenol molar ratio of 0.68:1. The solution was heated to reflux and 50% aqueous formaldehyde was added slowly, whilst maintaining reflux, in an amount corresponding to a formaldehyde:phenol molar ratio of 2.0:1. The initial reaction was carried out at a temperature between 75° and 80° C. and the temperature was then held at 80° C. until a viscosity in the range of from 170 to 180 cP (ICI cone and plate viscometer, 5 Poise cone at 25° C.) was reached. The resin was then quickly cooled and to it were added 1.8% by weight urea, 0.4% by weight silane and 3.8% by weight phenoxyethanol. The final viscosity was about 130 cP (as measured above).

2. Silicate Resin

2.1 Silicate Resin A

Sodium silicate solution characterised by the following composition:

| | |
|---|---|
| $SiO_2$ | 25% |
| $Na_2O$ | 12% |
| $Na_2CO_3$ | 0.55% |

Dry solids=43%, viscosity 350–400 cP, S.G. @ 20° C. 1.45.

3. Ester Hardeners 3.1 Ester Hardener A (for use with Alkaline Phenolic Resole Resin A)

Composition:

| | |
|---|---|
| Triacetin | 95% |
| Resorcinol | 5% |

3.2 Ester Hardener B (for use with Alkaline Phenolic Resole Resin B)

Methyl Formate-ex BASF 3.3 Ester Hardener C—(for use with Silicate Resin A)-

Propylene Carbonate

4. CARBON DIOXIDE 4.1 Hardener D (for use with Silicate Resin A)

Carbon Dioxide Gas ex L'Air Liquide

5. ADDITIVES 5.1 Silane A

γ-amino propyl silane 5% Water 95%

5.2 Metakaolin A

Geopolymite PS2 Powder ex Geopolymere, 60700 Pont Ste Maxence, France 5.3 Metakaolin B Metakaolin ex AGS Laboratory, France Particle size 0–20 micron 5.4 Metakaolin C Metakaolin ex AGS, France Particle size 0–100 micron 5.5 Kaolinite A Kaolin KP des Morbihen, 56270 Leurean Ploemeur 5.6 Kaolinite B GTY Clay ex Hoden Davis, Newcastle-under-Lyme, Staffordshire, UK 5.7 Halloysite A New Zealand Halloysite, Premium ex New Zealand China Clays Ltd., Northland, New Zealand 5.8 Calcium Montmorillonite A Berkbond No. 1 ex Steetley Minerals Ltd., Milton Keynes, UK 5.9 Bentonite A Bentonite L 1001D ex Hoben Davis, Newcastle-under-Lyme, Staffordshire, UK 5.10 Attpulgite A Attagel 50 ex Lawrence, UK 5.11 Vermiculite A Exfoliated DF ex Dupre, Hertford, UK Particle size 1–2 mm 5.12 Vermiculite B Supra Vermiculite L862D ex Hoben-Davis, Newcastle-under-Lyme, Staffordshire, UK Particle size<0.5 mm Test Methods

| | |
|---|---|
| LOSS ON IGNITION: | Weight loss after 45 minutes at 900° C. |
| ELUTABLE ALKALI: | (See below) |
| FINES: | Percentage passing 0.1 mm sieve |
| WATER SOLUBLE POTASSIUM AND SODIUM: | (See below) |
| FLEXURAL STRENGTH MEASUREMENTS: | (See below) |

Elutable Potassium Hydroxide/Sodium Hydroxide Method

Weigh out accurately about 50 g sand under test into a clean beaker, with magnetic follower. Add 50 ml distilled water and agitate on magnetic stirrer for 10 minutes. Check pH and then add 50 ml 0.05 M sulphuric acid via pipette. Place watch glass on top of the beaker and then heat to boiling point using a Bunsen burner with tripod and gauze. Immediately the contents of the beaker begin to boil remove heat and add 50 ml of distilled water, then cool to room temperature.

Titrate on pH meter, with agitation, with 0.1 M NaOH solution to pH 7.0.

$$\text{Potassium Hydroxide content} = \frac{\text{Titre to pH 7.0 (ml)} \times 0.56}{\text{weight of sand sample (g)}}$$

$$\text{Sodium hydroxide content} = \frac{\text{Titre to pH 7.0 (ml)} \times 0.40}{\text{weight of sand}}$$

Measurement of soluble potassium and sodium in reclaimed sand samples by flame photometry.

Equipment

Flame photometer, EEL (Corning)

Material

Standard Potassium Solution

A solution containing 10 ppm potassium was prepared from Analar Potassium Chloride carefully dried at 110° C.

Standard Sodium Solution

A solution containing 10 ppm sodium was prepared from Analar Sodium Chloride carefully dried at 110° C.

Sample Preparation

The sand sample, 10 g, was weighed into a 250 ml conical flask to which 250 ml deionised water was added. The flask was shaken and left to stand for 2 hours.

The solution was filtered through a Buckner funnel using Whatman No. 1 filter paper. A 10 ml sample was then diluted with deionised water to 100 ml in a volumetric flask to bring the concentration within the 10 ppm range for potassium or sodium.

Sand Treatment

Mechanically reclaimed sand (50 g), mineral additive (0.15 g) and water (0.15 g) were mixed in a 100 ml plastic beaker using a spatula for three minutes. A blank was prepared using mechanically reclaimed sand (50 g) and water (0.15 g) in a similar fashion. The sand mixtures (20 g) were weighed into a 50 ml silica crucible and placed in a furnace at the required temperature for 3 hours. The sand was allowed to cool prior to sample preparation.

Method for the Determination of Flexural Strength—Liquid Ester Cured Phenolics and Silicates a. Mixing Procedure 2500 g of sand is weighed into the mixing bowl of a 'Kenwood Chef' mixer and the temperature adjusted to 22° C. by dry mixing. The required amount of additive is weight into the sand and mixed for 2 minutes to achieve a homogeneous sand/additive mixture. If required, water is added and mixing continued for a further minute, followed by the hardener and a further 1 minute mixing. The resin is weighed into a disposable syringe and added to the sand mixture, while the mixer is operating, over a period of 10 seconds. The mixer is then run at maximum speed (300 rev/min) for 2 minutes prior to the preparation of the test specimens.

b. Determination of Flexural Strength

The binder/sand mixture is packed into two boxes each containing six moulds measuring 22.4×22.4×177.8 mm. The sand mixture is distributed evenly between the two boxes and is packed into the corners of each mould by hand. The sand is then rammed using a wooden strickling bar. Excess sand is removed by drawing a steel blade across the top of each box. A small quantity of binder/sand mixture is then placed along the middle of each box and carefully pressed using the steel blade. This is to ensure a consistent smooth surface across the middle of each bar at the pressure point where the testing instrument is in contact with the test bar.

Measurements are made using a Howden Tensometer fitted with flexural test jaws. Three test pieces are broken at timed intervals after mixing and an average of the strength measurements calculated.

Method for the Determination of Flexural Strength—Vapour Cured Phenolics and Silicates a. Mixing Procedure 2500 g of sand is weighed into the mixing bowl of a 'Kenwood Chef' mixer and the temperature adjusted to 22° C. by dry mixing. The required amount of additive is weighed into the sand and mixed for 2 minutes to achieve a homogeneous sand/additive mixture. If required water is added and mixing continued for a further minute. The resin is weighed into a disposable syringe and added to the sand mixture, while the mixer is operating, over a period of 10 seconds. The mixer is then run at maximum speed (300 rev/min) for 2 minutes prior to the preparation of the test specimens.

b. Determination of flexural strength

The binder/sand mixture is packed into a mould measuring 22.4×22.4×177.8 mm, the sand mixture is distributed evenly in the box and is packed into the corners of the mould by hand. The sand is then rammed using a wooden strickling bar. Excess sand is removed by drawing a steel blade across the top of each box. A small quantity of binder/sand mixture is then placed along the middle of each box and carefully pressed using the steel blade. This is to ensure a consistent smooth surface across the middle of each bar at the pressure point where the test sting instrument is in contact with the test bar.

The mould is gassed by passing vapour until the mould is fully cured.

Gassing Conditions for Alkaline Phenolic Resole Resins

Saturated methyl formate vapour in nitrogen gas stream at 0.1 bar passed through the mould for 15 seconds.

Gassing Conditions for Silicate Resins

Carbon dioxide gas from a cylinder at 0.1 bar passed through the mould for 60 secs.

Measurements are made using a Howden Tensometer fitted with flexural test jaws. Three test pieces are broken at a number of timed intervals after mixing and an average of the strength measurements calculated.

EXAMPLES DEMONSTRATING THE PRIOR ART

Liquid Ester Cured Phenolic

Typical strengths obtained with Alkaline Phenolic Resole Resin A with Ester Hardener A on new and untreated reclaimed sand are given in Table 1.

TABLE 1

| SAND TYPE | New (Bervialle 55/60 AFA) | Mechanically Reclaimed Sand(1) |
|---|---|---|
| RESIN % (Based on Sand) | 1.2 | 1.2 |
| HARDENER % (Based on Resin) | 22 | 22 |
| FLEXURAL STRENGTH ($kg/cm^2$) after: | | |
| 1 hour | 5 | 0 |
| 2 hours | 8.5 | 2.5 |
| 4 hours | 13 | 4 |
| 6 hours | 17 | 5 |
| 24 hours | 23.5 | 10 |

Sand Analysis:

| | Note (1) |
|---|---|
| Loss on ignition | 0.95% |
| Elutable potassium | 0.131% |
| Fines (<0.1 mm) | 0.13% |
| pH | 9.7 |

2. Vapour Ester Cured Phenolic

Typical strengths obtained with Alkaline Phenolic Resole Resin B with Ester Hardener B on new and untreated reclaimed sand are given in Table 2. Figures are included where water and silane additions have been made, according to prior art (EP130584).

TABLE 2

| SAND TYPE | NEW (SIFRACO LA32, 55/60 AFA) | | | Mechanically Reclaimed Sand (2) | | | Thermally Reclaimed Sand (3) | | |
|---|---|---|---|---|---|---|---|---|---|
| RESIN % (BASED ON SAND) | 1.65 | | | 1.65 | | | 1.65 | | |
| WATER % | — | 0.3 | — | — | 0.3 | — | — | 0.3 | — |
| SILANE A % | — | — | 0.3 | — | — | 0.3 | — | — | 0.3 |
| FLEXURAL STRENGTH ($kg/cm^2$) | | | | | | | | | |
| 0 min | 14.25 | 11.75 | 12 | 2.75 | 2.75 | 4.75 | 1.25 | 2.5 | 5.75 |
| 5 min | 17 | 15.5 | 15 | 3.5 | 4 | 7.5 | 2 | 4 | 6 |
| 15 min | 25 | 20 | 17 | 3 | 4 | 6 | 2 | 4 | 6.5 |
| 1 hour | 26 | 23 | 19 | 3 | 4 | 5.5 | 1.5 | 4 | 4.5 |
| 24 hour | 29.5 | 25 | 24 | 1.5 | 2.5 | 5 | 0 | 2.75 | 3.5 |

Sand Analysis:

| | NOTE [2] | NOTE [3] * |
|---|---|---|
| Loss on Ignition | 1.03% | <0.01% |
| Elutable Potassium | 0.16% | 0.074% |
| Fines (<0.1 mm %) | 0.15% | 0.05% |

* Treated at 800° C. for 12 hours and dedusted to remove fines

Strengths of alkaline phenolic resin binders on sand contaminated with residual sodium salts vary depending on the temperature to which the sand has been heated. Table 3 gives typical figures for Alkaline Phenolic Resole Resin A cured with Ester Hardener A.

TABLE 3

| SAND | 100% MECHANICALLY RECLAIMED SAND[4] | | | |
|---|---|---|---|---|
| HEAT TREATMENT | None | 3 hours @ 300° C. [5] | 3 hours @ 550° C. [6] | 3 hours @ 800° C. [7] |
| RESIN, % (BASED ON SAND) | 1.5 | 1.5 | 1.5 | 1.5 |
| HARDENER, % (BASED ON RESIN) | 21 | 21 | 21 | 21 |
| FLEXURAL STRENGTH ($kg/cm^2$) | | | | |
| After 24 hours | 6.7 | 2.0 | 4.9 | 11.7 |

Sand Analysis:

| | NOTE [4] | NOTE [5] | NOTE [6] | NOTE [7] |
|---|---|---|---|---|
| LOSS ON IGNITION | 2.63 | | | |
| ACID ELUTABLE SODIUM HYDROXIDE | 0.133 | 0.22 | 0.285 | 0.044 |
| WATER SOLUBLE SODIUM | 0.20 | 0.20 | 0.1230 | 0.008 |

The binding effect produced by the clay and free alkali is minimal as evidenced by the example given in Table 4. Addition of extra alkali to the Phenolic Resole Resin B when cured with Ester Hardener B results in poor cure of the phenolic resin. When alkail and clay alone are used no bonding of the sand is evident.

TABLE 4

| SAND | 100% Mechanically Reclaimed Sand [8] | |
|---|---|---|
| Resin, % (Based on Sand) | 1.65 | — |
| 15% KOH Solution (Based on Sand) | 2 | 2 |
| Metakaolin B, % (Based on Sand) | 0.3 | 0.3 |
| FLEXURAL STRENGTH ($Kg/cm^2$) | | |
| After 0 min | 2 | 0 |
| After 5 min | 2.5 | 0 |
| After 15 min | 3 | 0 |
| After 1 hour | 3.5 | 0 |
| After 24 hours | 4 | 0 |

Sand Analysis:

| | NOTE [8] |
|---|---|
| Loss on Ignition | 1.4% |
| Elutable Potassium Hydroxide | 0.184% |
| Fines (<0.1 mm) | 0.2% |

3. Liquid Ester Cured Silicate

Typical strengths obtained with Silicate Resin A and Ester Hardener C given on reclaimed sand are shown in Table 5.

TABLE 5

| SAND TYPE | Mechanically Reclaimed Sand [9] |
|---|---|
| RESIN % (Based on Sand) | 2.7 |
| HARDENER % (Based on Resin) | 10 |
| Flexural Strengths ($kg(cm^2)$ after: | |
| 72 hours | 8 |

Sand Analysis:

| | NOTE [9] |
|---|---|
| Loss on Ignition | 0.87% |
| % $Na_2CO_3$ | 0.55% |
| pH | 10.9 |
| % Fines (<0.1 mm) | 0.32 |

4. Carbon Dioxide Vapour Cured Silicate

Typical strength values for Silicate Resin A cured with Hardener D on new and reclaimed sand are given in Table 6.

TABLE 6

| SAND TYPE | New | Mechanically Reclaimed sand (see note [9]) |
|---|---|---|
| Resin % (Based on Sand) | 2.7 | 2.7 |
| FLEXURAL STRENGTH ($kg/cm^2$) after: | | |
| 0 min | 4 | 0 |
| 72 hours | 5 | 3 |

EXAMPLES DEMONSTRATING THE INVENTION

1. Liquid Ester Cured Phenolics

Results of rebonding mechanically reclaimed sand as described in Table 1 (after addition of additive and thermal treatment) with Alkaline Phenolic Resin A and Ester Hardener A are given in Table 7.

TABLE 7

| SAND | See Note [1] Table 1 | |
|---|---|---|
| Additive | Metakaolin A | Metakaolin A |
| Additive Addition Level (prior to heat treatment) | 0.6% | 0.95% |
| Water Addition Level (prior to heat treatment) | 0.4% | 0.6% |
| Heat Treatment | 1 hour @ 800° C. [10] | 1 hour @ 800° C. [11] |
| Resin % (Based on Sand) | 1.2% | 1.2% |
| Hardener % (Based on Resin) | 22% | 22% |

TABLE 7-continued

| SAND | See Note (1) Table 1 | |
|---|---|---|
| FLEXURAL STRENGTH (kg/cm$^2$) after: | | |
| 1 hour | 5 | 5.5 |
| 2 hours | 10 | 10 |
| 4 hours | 14 | 15 |
| 6 hours | 18 | 18 |
| 24 hours | 26 | 25.5 |

Sand Analysis:

| | NOTE (10) | NOTE (11) |
|---|---|---|
| Loss on Ignition | 0.02% | 0.02% |
| Elutable Potassium hydroxide | 0.106% | 0.085% |
| Fines (<0.1 mm) | 0.47% | 0.41% |
| pH | 9.2 | 7.5 |

On comparison with the results given in Table 1, it can be seen that the strengths are as good as obtained on new sand.

2. Vapour Ester Cured Phenolic

Results of rebonding mechanically and thermally reclaimed sand as described in Table 2 when treated after additive addition with Alkaline Phenolic Resole Resin B and Ester Hardener B are given in Table 8.

TABLE 8

| SAND | See Note (2) Table 2 | See Note (3) Table 2 |
|---|---|---|
| Additive Addition prior to heat treatment (Based on Sand) | — | — |
| Heat Treatment | — | 800° C., 12 hours and dedusting |
| Additive Addition prior to binder addition (Based on Sand) | Metakaolin B, 0.3% Water, 0.3% | Metakaolin B, 0.3% Water, 0.3% |
| Resin Addition (Based on Sand) | 1.65% | 1.65% |
| FLEXURAL STRENGTH (kg/cm$^2$) after: | | |
| 0 min | 7.75 | 10.25 |
| 5 min | 8.5 | 17 |
| 15 min | 8 | 21.5 |
| 1 hour | 9 | 21 |
| 24 hours | 9.5 | 21.5 |

Table 9 illustrates the effect of different addition levels of additive Metakaolin B to mechanically reclaimed sand.

TABLE 9

| SAND | See Note (12) | | | |
|---|---|---|---|---|
| Additive Level (Based on Sand) | 0.3% | 0.1% | 0.05% | 0.01% |
| Water Addition (Based on Sand) | 0.3% | 0.3% | 0.3% | 0.3% |
| Resin Addition (Based on Sand) (Phenolic Resole B) | 1.65% | 1.65% | 1.65% | 1.65% |
| FLEXURAL STRENGTH (kg/cm$^2$) after: | | | | |
| 0 min | 6.25 | 4 | 2.5 | 2 |
| 5 min | 7 | 4 | 3 | 1.5 |
| 15 min | 7 | 5 | 4 | 2.5 |

TABLE 9-continued

| SAND | See Note (12) | | | |
|---|---|---|---|---|
| 1 hour | 7.5 | 5.5 | 4 | 2 |
| 24 hours | 10 | 6.5 | 3 | 2 |

Sand Analysis:

| SAND ANALYSIS | NOTE (12) |
|---|---|
| Loss on Ignition | 1.2% |
| Elutable Potassium hydroxide | 0.177% |
| Fines (<0.1 mm) | 0.5% |

The same materials show a significantly greater strength improvement when the mechanically reclaimed sand is thermally treated. The results are shown in Table 10.

TABLE 10

| SAND | See Note (12) | | | |
|---|---|---|---|---|
| Additive addition prior to heat treatment | None | | | |
| Heat treatment | 3 hours @ 800° C. (See Note (13)) | | | |
| Additive Addition (Based on Sand) | 0.3% | 0.1% | 0.05% | 0.01% |
| Water Addition (Based on Sand) | 0.3% | 0.3% | 0.3% | 0.3% |
| Resin Addition (Based on Sand) (Phenolic Resole Resin B) | 1.65% | 1.65% | 1.65% | 1.65% |
| FLEXURAL STRENGTH (kg/cm$^2$) after: | | | | |
| 0 min | 11 | 9.25 | 9 | 3.25 |
| 5 min | 16.5 | 12.5 | 10.5 | 3 |
| 15 min | 17 | 15.5 | 14 | 3.5 |
| 1 hour | 21 | 17 | 16 | 3 |
| 24 hours | 23.35 | 19 | 14.25 | 1 |

Sand Analysis:

| | NOTE (13) |
|---|---|
| Loss on Ignition | <0.01% |
| Elutable Potassium hydroxide | 0.14% |
| Fines (<0.1 mm) | 0.5% |

It can be seen that an addition level of 0.05% and above gives a significant improvement in strength.

Table 11 shows that many different types of clay may be used as a pretreatment prior to thermal treatment to give improvements in rebond strengths. The examples which contain no additive and additive 'Vermiculite A' do not form part of the invention but are included for comparison purposes. The examples using Vermiculite A and Vermiculite B demonstrate that particle size is a factor in determining whether additives are useful for the invention. Particle size of >0.5 mm is considered too large to be effective. However, for smaller particles no significant differences are seen in the performance characteristics at differing particle size ranges as evidenced by the results of Metakaolin B and Metakaolin C which have particle size distributions of 0–20 microns and 0–100 microns respectively.

A relationship is demonstrated between rebond strength (Flexural Strength (kg/cm$^2$) after 0 mins) and the amount of water soluble potassium (see FIG. 1).

TABLE 11

| SAND | 100% Mechanically Reclaimed Sand[14] | | | | | |
|---|---|---|---|---|---|---|
| WATER % | 0.3% | | | | | |
| Additive % | 0 | 0.3% | | | | |
| Additive (Additive and Water added prior to heat treatment) | — | Metakaolin B | Metakaolin C | Kaolinite A | Kaolinite B | Halloysite A |
| Heat treatment | 800° C. for 3 hours followed by dedusting | | | | | |
| Resole Resin B addition | 1.65% | | | | | |
| Extra water % | 0.3% | | | | | |
| FLEXURAL STRENGTH (kg/cm$^2$) | | | | | | |
| 1 min | 4.5 | 13 | 12 | 10.5 | 13 | 11 |
| 5 min | 10.5 | 17 | 16.5 | 10 | 17 | 14 |
| 15 min | 12 | 19 | 19 | 13 | 21 | 20 |
| 1 hr | 9 | 23 | 22 | 15 | 25 | 22 |
| 24 hrs | 4.5 | 22.5 | 22 | 17.5 | 23 | 23 |
| Supplier | | AGS (LAB) | AGS (PLANT) | Kaolin des Kerbhan | Hoben Davis | New Zealand China Clays |
| Country | | FRANCE | FRANCE | FRANCE | UK | NEW ZEALAND |
| THERMICALLY RECLAIM AND DEDUSTED SAND CHARACTERISTICS | | | | | | |
| Free flowing | No | Yes | Yes | Yes | Yes | Yes |
| % Fines <(0.1 mm) | 0.13 | 0.33 | 0.34 | 0.4 | 0.17 | 0.41 |
| % KOH (acid elutable) | 0.162 | 0.097 | 0.096 | 0.087 | 0.108 | 0.095 |
| % KOH (water soluble) | 0.033 | 0.012 | — | — | 0.02 | 0.019 |

| SAND | 100% Mechanically Reclaimed Sand[14] | | | | |
|---|---|---|---|---|---|
| WATER % | 0.3% | | | | |
| Additive % | 0.3% | | | | |
| Additive (Additive and Water added prior to heat treatment) | Calcium Montmorillonite A | Bentonite A | Attapulgite A | Vermiculite A | Vermiculite B |
| Heat treatment | 800° C. for 3 hours followed by dedusting | | | | |
| Resole Resin B addition | 1.65% | | | | |
| Extra water % | 0.3% | | | | |
| FLEXURAL STRENGTH (kg/cm$^2$) | | | | | |
| 1 min | 6.5 | 8.5 | 13 | 4 | 9 |
| 5 min | 9 | 9 | 17 | 9 | 13 |
| 15 min | 10 | 10 | 21 | 8.5 | 17 |
| 1 hr | 12 | 12 | 21 | 7.5 | 15 |
| 24 hrs | 8.5 | 11 | 22.5 | 4.5 | 8 |
| Supplier | Steetley | Hoben Davis | Lawrence | Dupre | Hoben Davis |
| Country | UK | UK | UK | UK | UK |
| THERMALLY RECLAIM AND DESUSTED SAND CHARACTERISTICS | | | | | |
| Free flowing | 50:50 | 50:50 | Yes | No | 50:50 |
| % Fines <(0.1 mm) | 0.38 | 0.36 | 0.34 | 0.27 | 0.22 |
| % KOH (acid elutable) | 0.081 | 0.098 | 0.087 | 0.157 | 0.117 |
| % KOH (water soluble) | 0.028 | 0.019 | 0.010 | 0.028 | 0.025 |

Sand Analysis:

| | Note [14] |
|---|---|
| Loss on Ignition | 1.12% |
| Elutable Potassium Hydroxide | 0.19% |
| Fines (<0.1 mm) | 1.08% |

Sand contaminated with sodium salts may be treated with an additive, in this case Metakaolin B, to yield significantly better results than those obtained without additive. Results given in Table 12 below show the strengths obtained using Alkaline Phenolic Resin A cured with Ester Hardener A and incorporating Metakaolin B and compare with results given above in Table 3 where the same heat treatment was applied but no additive employed.

TABLE 12

| SAND | 100% Mechanically Reclaimed Sand (see Note [4]) |
|---|---|
| Additive, % (based on sand) | Metakaolin B, 0.3% |
| Water, % (based on sand) (Additive and | 0.3% |

TABLE 12-continued

| SAND | 100% Mechanically Reclaimed Sand (see Note [4]) | | | |
|---|---|---|---|---|
| water added prior to heat treatment) Heat treatment | None [15] | 3 hours @ 300° C. [16] | 3 hours @ 550° C. [17] | 3 hours @ 800° C. [18] |
| Resin, % | 1.5 | 1.5 | 1.5 | 1.5 |
| Hardener, % | 21 | 21 | 21 | 21 |
| FLEXURAL STRENGTH ($kg/cm^2$) | | | | |
| After 24 hours | 7.9 | 3.3 | 23.0 | 21.7 |

Sand Analysis:

| | NOTE [15] | NOTE [16] | NOTE [17] | NOTE [18] |
|---|---|---|---|---|
| Loss on Ignition | | | | |
| Acid Elutable Sodium Hydroxide | 0.258 | 0.170 | 0.056 | 0.098 |
| Water Soluble Sodium | 0.175% | 0.170% | 0.085% | 0.003% |

Liquid Ester Cured Silicate

Results of rebonding mechanically reclaimed sand as described in Table 5 but with addition of Metakaolin A are shown in Table 13. The binder system used was Silicate Resin A and Ester Hardener C.

TABLE 13

| SAND | See Note [9] Table 5 | |
|---|---|---|
| Additive, % (Based on Sand) | 0.3% | 0.6% |
| Water, % (Based on Sand) | 0.3% | 0.6% |
| Resin, % (Based on Sand) | 2.7% | 2.7% |
| Hardener, % (Based on Resin) | 10% | 10% |
| FLEXURAL STRENGTH ($kg/cm^2$) | | |
| After 72 hours | 13.5 | 16 |

4. Carbon Dioxide Vapour Cured Silicate

Improvements in strength obtained when rebonding mechanically reclaimed sand as described in Table 6 but with the addition of Metakaolin A are shown in Table 14. The binder system used was Silicate Resin A and Hardener D.

TABLE 14

| SAND | See Note [9] Table 5 |
|---|---|
| Additive, % (Based on Sand) | 0.6% |
| Water, % (Based on Sand) | 0.6% |
| Resin, % (Based on Sand) | 2.7% |
| FLEXURAL STRENGTH ($kg/cm^2$) after: | |
| 0 min | 2 |
| 72 hours | 4.5 |

We claim:

1. A composition for use in the manufacture of foundry molds and cores which comprises a mixture of a particulate refractory aggregate with, as an additive thereto, a particulate clay characterized in that the particulate refractory aggregate comprises sand recovered from spent foundry molds and cores, and optionally new sand, which contains one or more alkali metal salts capable of reacting with the particulate clay and in that the particulate clay is capable of reacting with the alkali metal salts contained in the particulate refractory aggregate such that reaction occurs between the particulate clay and the alkali metal salts when mixed together and wherein the particulate clay has a particle size of less than 0.5 mm and is present in an amount of from 0.05 to 5% by weight based on the weight of the recovered sand.

2. A particulate refractory composition according to claim 1, wherein the particulate refractory aggregate comprises sand recovered from spent foundry molds or cores containing an ester-cured phenolic resin binder, an ester-cured silicate binder or a $CO_2$-cured silicate binder.

3. A particulate refractory composition according to claim 1, wherein the sand and the particulate clay additive are, together, subjected to a heat treatment at a temperature of from 400° to 1000° C.

4. A particulate refractory composition according to claim 1, wherein the particulate clay additive is at least one substance selected from the group consisting of kaolins, smectites, montmorillonites, bentonites, vermiculites, attapulgites, serpentines, glauconites, illites, allophanes and imogolites.

5. A refractory composition according to claim 4, wherein the particulate clay additive is kaolin.

6. The refractory composition according to claim 5, where the kaolin is thermally treated kaolin.

7. A particulate refractory composition according to claim 1, which additionally contains water.

8. A method of preparing a particulate refractory composition for use in the manufacture of foundry molds or cores which method comprises the steps of breaking up spent foundry molds or cores comprising sand which contains one or more alkali metal salts to recover the sand containing the one or more alkali metal salts and mixing the recovered sand with from 0.05 to 5% by weight based on the weight of the recovered sand of a particulate clay having a particle size of less than 0.5 mm, the said one or more alkali metal salts contained in the said recovered sand being capable of reacting with the said particulate clay and the said particulate clay being capable of reacting with the said one or more alkali metal salts such that a reaction occurs between the said one or more alkali metal salts and the said particulate clay when mixed together.

9. A method according to claim 8, wherein the spent foundry molds or cores comprise sand and a binder selected from the group consisting of an ester-cured phenolic resin binder, an ester-cured silicate binder and a $CO_2$-cured silicate binder.

10. A method according to claim 8, wherein the mixture of sand and particulate clay is subjected to a heat treatment at a temperature of from 400° C. to 1000° C.

11. A method according to claim 10, which additionally comprises the step of removing dust and/or fines during and/or after the heat treatment.

12. A method according to claim 8, wherein the particulate clay is at least one substance selected from the group consisting of kaolin, smectite, montomorillonite, bentonite, vermiculite, attapulgite, serpentine, glauconite, illite, allophane and imogolite.

13. The method according to claim 12, wherein the clay is a kaolin which has been thermally treated.

14. A particulate refractory composition prepared by the method claimed in claim 8.

15. A foundry molding composition comprising a mixture of a particulate refractory aggregate with, as an additive thereto, a particulate clay, and a liquid curable binder in an amount of from 0.05 to 5% by weight based on the weight of the particulate refractory material characterized in that the particulate refractory aggregate comprises sand recovered from spent foundry molds and cores, and optionally new sand, which contains one or more alkali metal salts capable of reacting with the particulate clay and in that the particulate clay is capable of reacting with the alkali metal salts contained in the particulate refractory aggregate such that reaction occurs between the particulate clay and the alkali metal salts when mixed together and wherein the particulate clay has a particle size of less than 0.5 mm and is present in an amount of from 0.05 to 5% by weight based on the weight of the recovered sand.

16. The foundry molding composition of claim 15, wherein the particulate clay is present in an amount of from 0.05 to 2% by weight, based on the weight of the sand.

17. A foundry molding composition according to claim 15, wherein said particulate refractory aggregate comprises sand recovered from spent foundry molds or cores containing an ester-cured phenolic resin binder, an ester-cured silicate binder or a $CO_2$-cured silicate binder.

18. A foundry molding composition according to claim 15, wherein the particulate clay is at least one substance selected from the group consisting of kaolin, smectite, montmorillionite, bentonite, vermiculite, attapulgite, serpentine, glauconite, illite, allophane and imogolite.

19. A foundry molding composition according to claim 15, wherein the particulate clay is kaolin.

20. The foundry molding composition according to claim 19, where the kaolin is thermally treated kaolin.

21. A foundry molding composition according to claim 15, which additionally contains water.

22. A foundry molding composition according to claim 15, wherein the liquid curable binder is an ester-curable phenolic resin.

23. A foundry molding composition according to claim 22, which additionally contains a liquid ester curing agent to cure the ester-curable binder.

24. A method of making a foundry mold or core comprising preparing a composition according to claim 23, forming the composition into the desired pattern or shape and allowing the ester-curable binder to undergo cure.

25. A method of making a foundry mold or core comprising preparing a composition according to claim 22, forming the composition into the desired pattern or shape and gassing the formed composition with a gaseous ester to bring about cure of the binder.

26. A method according to claim 25, wherein the gaseous ester is methyl formate.

27. A foundry molding composition according to claim 22, wherein the ester-curable phenolic resin is an aqueous alkaline phenol-formaldehyde resole resin.

28. A foundry molding composition according to claim 15, wherein the liquid curable binder is an ester-curable silicate.

29. A method of making a foundry mold or core comprising preparing a composition according to claim 15, wherein the liquid curable binder is a $CO_2$-curable silicate, forming the composition into the desired pattern or shape and gassing the formed compositions with $CO_2$ to bring about cure of the binder.

* * * * *